US005696343A

United States Patent [19]

Nakata

[11] Patent Number: 5,696,343

[45] Date of Patent: Dec. 9, 1997

[54] AUTOMATIC PLAYING APPARATUS SUBSTITUTING AVAILABLE PATTERN FOR ABSENT PATTERN

[75] Inventor: Takuya Nakata, Hamamatsu, Japan

[73] Assignee: Yamaha Corporation, Japan

[21] Appl. No.: 563,498

[22] Filed: Nov. 28, 1995

[30] Foreign Application Priority Data

Nov. 29, 1994 [JP] Japan ..... 6-294784

[51] Int. Cl.[6] ..... G10H 1/36; G10H 7/00

[52] U.S. Cl. ..... 84/609; 84/610; 84/634

[58] Field of Search ..... 84/604–606, 609–613, 84/634–637

[56] References Cited

U.S. PATENT DOCUMENTS

| | | | |
|---|---|---|---|
| 5,113,744 | 5/1992 | Tanaka et al. . | |
| 5,164,531 | 11/1992 | Imaizumi et al. | 84/634 |
| 5,382,749 | 1/1995 | Fujita et al. | 84/603 |

FOREIGN PATENT DOCUMENTS

| | | |
|---|---|---|
| 0 597 381 A2 | 4/1993 | European Pat. Off. . |
| 0 597 381 A2 | 5/1994 | European Pat. Off. . |
| 4-6598 | 1/1992 | Japan . |
| 4-7519 | 2/1992 | Japan . |

*Primary Examiner*—William M. Shoop, Jr.
*Assistant Examiner*—Marlon T. Fletcher
*Attorney, Agent, or Firm*—Graham & James LLP

[57] ABSTRACT

An automatic playing apparatus registers pattern data representative of a plurality of performance patterns in a storage, and sequentially designates performance patterns to form a music composition. The apparatus sequentially retrieve the pattern data of the designated performance patterns from the storage to reproduce a sequence of the designated performance patterns to undergo an automatic play of the music composition. The apparatus operates when incidentally designating an absent performance pattern which is not registered in the storage for substituting an available one of the registered performance patterns for the absent performance pattern so as to maintain the automatic play.

15 Claims, 12 Drawing Sheets

FIG. 3

| # | Pattern Name |
|---|---|
| | **Dance** |
| 1 | DA Stork |
| 2 | DA Mage! |
| 3 | DA Frame |
| 4 | DA ABCDE |
| 5 | DA Disco |
| 6 | DA Train |
| 7 | DA Tekno |
| 8 | DA Craze |
| 9 | DA Ibiza |
| 10 | DA Light |
| 11 | DA Chuck |
| 12 | DA Quiri |
| 13 | DA Funky |
| 14 | DA GitUp |
| 15 | DA Queen |
| 16 | DA Dark? |
| 17 | DA Mitch |
| 18 | DA Weigh |
| | **Ballad** |
| 19 | BA Ltade |
| 20 | BA Group |
| 21 | BA Gofer |
| 22 | BA Quiet |
| 23 | BA Lovlt |
| 24 | BA Magma |
| 25 | BA Venus |
| 26 | BA Human |
| 27 | BA RioDJ |
| 28 | BA Grand |
| 29 | BA Witby |
| 30 | BA RWalz |
| 31 | BA RWalz |
| 32 | BA RWalz |

| # | Pattern Name |
|---|---|
| | **Rock&Pop** |
| 33 | RP Mouth |
| 34 | RP GetUP |
| 35 | RP Rozza |
| 36 | RP Faces |
| 37 | RP Urple |
| 38 | RP Rhino |
| 39 | RP N.Y.! |
| 40 | RP Lady? |
| 41 | RP Start |
| 42 | RP Troll |
| 43 | RP Stash |
| 44 | RP Earth |
| 45 | RP Candy |
| 46 | RP SeeYa |
| 47 | RP River |
| 48 | RP Judge |
| 49 | RP Slap |
| 50 | RP Sink! |
| | **Rhythm&Blues** |
| 51 | RB Shore |
| 52 | RB Motor |
| 53 | RB Going |
| 54 | RB Brass |
| 55 | RB NFunk |
| 56 | RB Skunk |
| 57 | RB CFS01 |
| 58 | RB Lucky |
| 59 | RB Moo! |
| 60 | RB South |
| | **Hard Rock** |
| 61 | HR Speed |
| 62 | HR Drive |
| 63 | HR HurtN |
| 64 | HR Nervs |
| 65 | HR Piles |
| 66 | HR BoogE |
| 67 | HR Help! |

| # | Pattern Name |
|---|---|
| | **Rock&Roll** |
| 68 | RR Beach |
| 69 | RR Bravy |
| 70 | RR Tongs |
| 71 | RR Crock |
| 72 | RR Billy |
| 73 | RR Kling |
| | **Jazz** |
| 74 | JA Dook! |
| 75 | JA Swing |
| 76 | JA BeBop |
| 77 | JA Dixie |
| 78 | JA Zzz.. |
| 79 | JA Foxy! |
| 80 | JA Vince |
| 81 | JA WFuse |
| 82 | JA EFuse |
| | **Latin** |
| 83 | LA Salsa |
| 84 | LA Bamba |
| 85 | LA Latin |
| 86 | LA Samba |
| 87 | LA Bossa |
| 88 | LA ChCha |
| 89 | LA Rumba |
| 90 | LA Tango |
| | **Reggae** |
| 91 | RE Cycle |
| 92 | RE Tired |
| 93 | RE Guitar |
| | **World** |
| 94 | WO Ethno |
| 95 | WO Grass |
| 96 | WO Polka |
| 97 | WO Mrch1 |
| 98 | WO Mrch2 |
| 99 | WO Waltz |
| 100 | WO RCade |

| | |
|---|---|
| Designated style | ○ ○ |
| Substitutive style 1 | × × |
| Substitutive style 2 | × × |
| Substitutive style 3 | × × |
| ⋮ | × × |

Priority order

AUTOMATIC PLAYING APPARATUS SUBSTITUTING AVAILABLE PATTERN FOR ABSENT PATTERN

BACKGROUND OF THE INVENTION

This invention relates to an automatic playing apparatus which stores plural kinds of automatic pattern data representative of accompaniment patterns and which sequentially reads out the stored data to play a music composition automatically.

In a conventional automatic playing apparatus, a plurality of automatic playing pattern data are labeled by identification codes, and desired data specified by the identification code is read out to play a music composition automatically. A recent automatic playing apparatus registers plural kinds of accompaniment patterns selectively used during automatic playing. Song data of one music composition used in such an automatic playing apparatus is composed of sequence data of melody and accompaniment pattern designating data. The automatic playing apparatus reads out the accompaniment pattern designating data from the song data so as to sequentially reproduce the designated accompaniment patterns automatically.

When such an automatic playing apparatus receives song data created by another automatic playing apparatus, it may encounter a difficulty where the song data contains accompaniment pattern designating data which incidentally designates an absent accompaniment pattern which is not registered in the receiving apparatus. Apart from the song data, when an accompaniment pattern may be designated by an external music apparatus through a MIDI cable or the like, the automatic playing apparatus may encounter a difficulty where the designated accompaniment pattern is not stored in itself. When the conventional automatic playing apparatus encounters such a difficulty, the apparatus cannot automatically play the music composition because a function to select another substitutional accompaniment pattern is not provided in the conventional apparatus.

SUMMARY OF THE INVENTION

An object of the present invention is to provide an automatic playing apparatus which can play a music composition automatically by substituting other similar pattern data for designated pattern data when the designated pattern data is not available.

According to the present invention, an automatic playing apparatus comprises storage means for registering pattern data representative of a plurality of performance patterns, designating means for sequentially designating performance patterns to form a music composition, playing means for sequentially retrieving the pattern data of the designated performance patterns from the storage means to reproduce a sequence of the designated performance patterns to undergo an automatic play of the music composition, and substituting means operative when the designating means incidentally designates an absent performance pattern which is not registered in the storage means for substituting an available one of the registered performance patterns for the absent performance pattern so as to maintain the automatic play.

In a first form, the substituting means comprises means defining a reference table which lists performance patterns in organized manner, and searching means operative when an absent performance pattern is designated for searching the reference table so as to select one of the listed performance patterns, which substitutes for the absent performance pattern. In detail, the reference table is organized into a plurality of blocks such that the searching means specifies one block corresponding to the absent performance pattern and selects one listed performance pattern from the specified block.

In a second form, the substituting means comprises searching means operative when an absent performance pattern is designated for searching the storage means to select therefrom one registered performance pattern which is akin to the absent performance pattern to thereby substitute therefor. In detail, the searching means comprises selecting means for selecting an akin performance pattern which has an identical Or similar style as that of the absent performance pattern. Further, the selecting means comprises means for selecting the akin performance pattern having the same meter as that of the absent performance pattern. Moreover, the selecting means comprises means for selecting the akin performance pattern having the same beat as that of the absent performance pattern. In variation, the storage means registers the pattern data containing reference information which prescribes attributes of the registered performance patterns such that the searching means selects one registered performance pattern akin to the absent performance pattern according to the reference information.

In a third form, the storage means comprises means for storing the pattern data in organized manner such that the plurality of the performance patterns are sorted into groups labeled by primary codes, each group containing similar performance patterns labeled individually by secondary codes, and the substituting means comprises selecting means operative when the designating means designates an absent performance pattern having certain primary and secondary codes for specifying one group having the same primary code as that of the absent performance pattern and for selecting from the specified group one registered performance pattern having a secondary code different than that of the absent performance pattern so as to substitute therefor. In detail, the selecting means comprises means for selecting said one registered performance pattern having the same meter as that of the absent performance pattern. Further, the selecting means comprises means for selecting said one registered performance pattern having the same beat as that of the absent performance pattern.

In modification, the inventive automatic playing apparatus includes memory means for memorizing an automatic music data which prescribes a music composition for an automatic play and which contains designation information so that the designating means retrieves the designation information from the memory means for designating a sequence of performance patterns according to the retrieved designation information. Alternatively, the designating means comprises means receptive of an external automatic music data which prescribes a music composition for an automatic play and which contains designation information, for designating a sequence of performance patterns according to the received designation information.

In a form, the storage means comprises means for registering the performance patterns labeled by identification codes such that the designating means sequentially designates the performance patterns in terms of the identification codes.

In another form, the substituting means includes means operative when the designating means designates a present performance pattern which is registered in the storage means and subsequently designates an absent performance pattern which is not registered in the storage means, for substituting the present performance pattern for the absent performance pattern.

In the automatic playing apparatus of the invention, a plurality of performance patterns are stored in the storage means, and the performance pattern specified by the designating means is read out from the storage means to play the music composition automatically. In this case, when the designating means specifies an absent pattern which is not stored in the storage means, an appropriate pattern is selected from the registered patterns stored in the storage means for use as a substitute, whereby the music composition is played successfully. Thus, even when the specified pattern is not available, the automatic playing is not interrupted.

According to the first method of selecting a substitutive pattern, candidates for substitutive patterns are listed in a reference table. When a pattern not stored in the storage means is designated, the reference table is searched for the substitutive pattern. According to the second method of selecting a substitutive pattern, when a pattern not stored in the storage means is designated, the storage means is searched to extract an akin pattern which has a close relation to the designated pattern, i.e., identical or similar in genre, identical in meter, identical in beat and so on. Thus, the extracted akin pattern is used as the substitutive pattern. Thus, even when a different pattern is used as a substitute, the automatic playing is maintained without disturbing atmosphere or mood of the music composition.

According to the third method, the registered patterns having a certain relation to each other, i.e. identical or similar in genre, identical in meter, identical in beat and so on, may be grouped and stored in the storage means. In this case, when a pattern not stored in the storage means is specified, another pattern is extracted as a substitute from a group to which the specified pattern belongs, whereby the automatic playing is continuously performed without disturbing the mood of the music composition.

BRIEF DESCRIPTION OF DRAWINGS

FIG. 3 is a diagram showing configuration of a pattern data memory of the electronic musical instrument of FIG. 1.

DETAILED DESCRIPTION OF EMBODIMENTS

Figure 1:
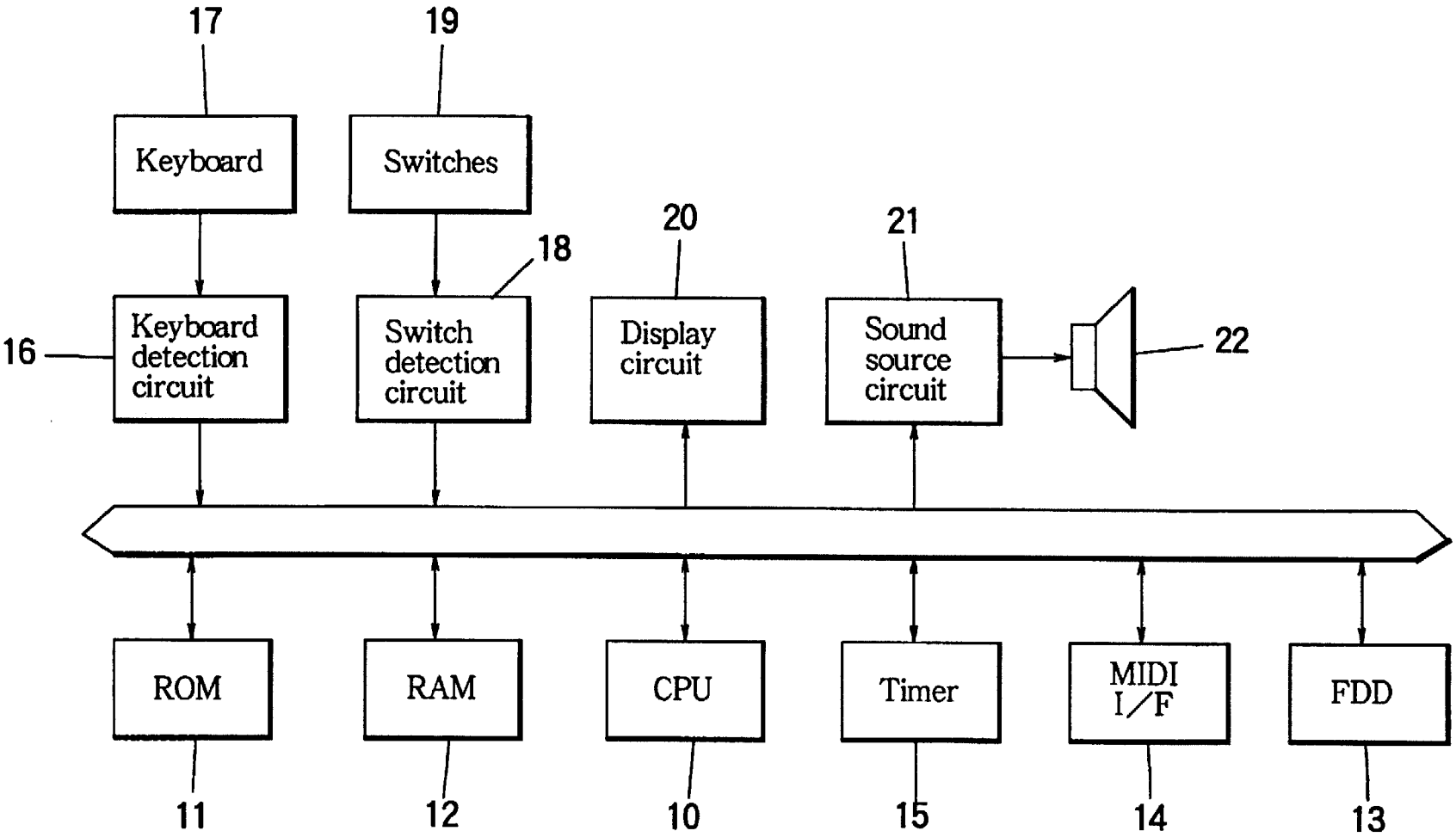
FIG. 1 is a block diagram showing an electronic musical instrument provided with an automatic playing function according to a first embodiment of the invention.

FIG. 1 is a block diagram of an electronic musical instrument having an automatic playing function according to a first embodiment of the invention. This electronic musical instrument has a keyboard 17 to allow a player to manually play for producing a musical sound. The instrument also can perform automatic play by setting a floppy disk containing music data, which is automatic playing data of a musical composition, in a floppy disk drive (FDD) 13 and by reading the music data.

Figure 2A:
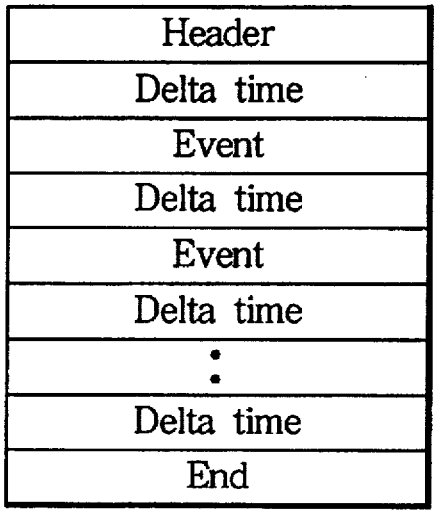
FIGS. 2A and 2B are a diagram showing a data format of music data and pattern data stored in the electronic musical instrument of FIG. 1.

As shown in FIG. 2A, the music data is sequence data composed of various kinds of event data and delta time data indicative of a duration between events. The event data and the delta time data are alternately arranged. The event data in the music data is composed of melody data and pattern designation data. The melody data is used to control producing/muting or the like of melody tones. The pattern designation data designates accompaniment pattern data which is called "style data". The style data is stored in a ROM (style memory) of the electronic musical instrument. The style data is sequence data which represents accompaniment patterns prescribed in a length of several measures. When the electronic musical instrument detects style designation data or pattern designation data during automatically playing a music compositions the instrument reads the designated style data and plays an accompaniment automatically.

Referring back to FIG. 1, a CPU 10, which is a control block, is connected through a bus to a ROM 11, a RAM 12, a floppy disk drive 13, a MIDI interface (I/F) 14, a timer 15, a keyboard detection circuit 16, a switch detection circuit 18, a display circuit 20, and a sound source circuit 21. The ROM 11 is composed of a program memory and a style data memory. The program memory contains control programs for controlling the operation of the electronic musical instrument. The style data memory contains the above mentioned style data and a reference table which is described later. Automatic playing data or music data is read from a floppy disk and written into the RAM 12, and also various registers are set in the RAM 12 for temporarily storing various data during automatic playing of music. The floppy disk containing music data or the like is set in the floppy disk drive 13. An external MIDI equipment may be connected to the MIDI interface 14. MIDI tone data to be played automatically and MIDI style designation data are received therethrough from the external MIDI equipment. The timer 15 is a circuit to generate an interruption command to the CPU 10 at a periodic time interval. The interval of generating an interruption command is determined by tempo data contained in the music data and style data. A keyboard 17 is connected to the keyboard detection circuit 16. The keyboard 17 has a compass of about 5 octaves and is fitted with key ON switches to detect a ON/OFF state of keys and sensors to detect an intensity of initial touch and aftertouch of keys. The CPU 10 reads the ON/OFF state of the key ON switches and values detected by the sensors through the keyboard detection circuit 16. Various switches 19 are connected to the switch detection circuit 18. The switches 19 include, for example, mode selector switches to select a mode such as a play mode (a mode in which a player manually plays on the keyboard 17 by himself/herself) and an automatic playing mode (a mode in which the music data is read to play automatically) and timbre selector switches to select a timbre in the automatic playing mode. The ON/OFF state of these switches is detected by the switch detection circuit 18. The results of the detection are read by the CPU 10. The display circuit 20 displays a currently selected timbre name, the title of a musical composition being played automatically and the like. The sound source circuit 21 generates a musical sound signal based on sound production data inputted from the CPU 10. The sound source circuit 21 can produce rhythm sounds having no pitches as well as musical sounds of wind instruments, string instruments, percussion instruments and the like which can present melodies and chords at desired pitches. The sound production data is inputted from the CPU 10 to the sound source circuit 21 in order to produce musical sounds having pitches. The sound production data includes a note ON signal, pitch specifying data, and channel specifying data. The sound production data is inputted from the CPU 10 to the sound source circuit 21 in order to produce musical sounds having no pitch. In such a case, the sound production data includes a note ON signal, rhythm sound specifying data, and channel specifying data. The musical sound signal is inputted from the sound source circuit 21 to a sound system 22. The sound system 22 imparts various effects to the musical sound signal, amplifies the signal, and then outputs the amplified signal to a loudspeaker or the like.

FIG. 2A shows a schematic configuration of music data (hereinafter, referred to as "song data") stored in the aforesaid floppy disk or the like. A header is formed at the top of the song data. The header contains the title of a musical composition represented by the song data, playing time, playing tempo, timbres assigned to channels 1 to 16 of the sound source circuit 21. As described before, the body of the song data contains sequence data composed of alternately arranged delta time data and event data. The delta time data indicates a time interval or duration between event data located immediately before the delta time data and event data located immediately after the delta time data. The time interval is represented in terms of clocks of the timer 15. The event data is composed of a note event (note ON or note OFF), other playing events such as a sound volume event, a pitch bend event and the like, a chord specifying event, and a style designation event including a bank number specifying event, a style number specifying event, a section number specifying event. When a note event or another playing event is read, the event data is sent to a play operation block such as the sound source circuit 21. The sound source circuit 21 controls operation of reproducing a musical sound signal on the basis of the inputted event data. When the chord specifying event data is read, root data and type data contained in the chord specifying data are stored in registers ROOT and TYPE, respectively. The chord specifying data is used as a reference for determining a chord sound and for shifting the pitch of a bass sound when style data or pattern data is to be reproduced automatically.

Figure 2B:
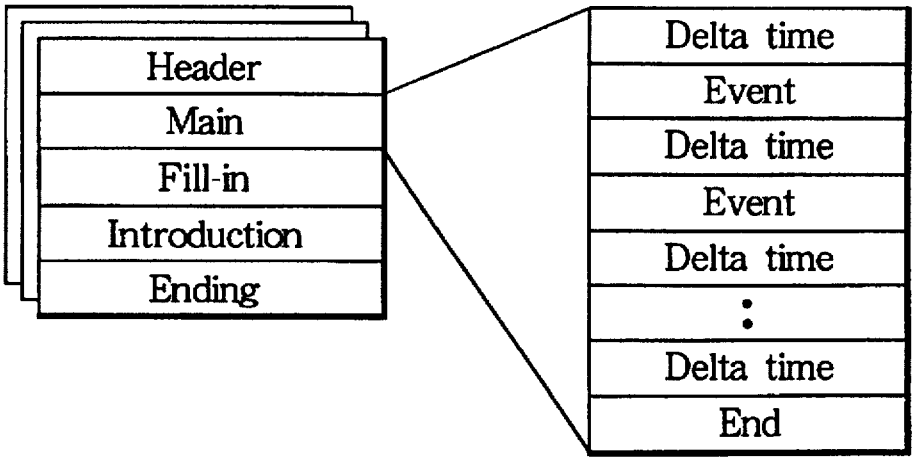

Here, the style data memory is composed of a plurality of banks. As shown in FIG. 2B and FIG. 3, a plurality of style data representative of accompaniment or performance patterns (1 to 100 in FIG. 3) are stored in each bank. Accordingly, by specifying a bank number and a style number, one piece or one pattern of style data can be specified. Actually each of style data is composed of four pieces of section data. Therefore, in addition to the bank number and the style number, a section number is specified for actually playing the music, whereby one piece of pattern can be specified or designated for use in playing an accompaniment automatically.

In FIG. 2B, the style data is composed of four pieces of section data, namely header and main, fill-in, introduction, and ending. The header contains index or reference information indicative of attributes of the style data, such as the name of the style data, genre, meter, beat and the like. Genre is a name indicative of a category of music, such as Rock, Pops, Jazz, Latin and the like. The meter indicates the number of notes per measure, and triple time, quadruple time and the like are commonly known. The beat indicates counts of rhythmical units of time within one measure, and four beats, eight beats, sixteen beats and the like are commonly known for melodies of the quadruple time family. Style data identical or similar in genre and identical in meter can be said to be mutually similar or akin style data.

Each section data is composed of an accompaniment pattern for several measures. As shown at the right hand of FIG. 2B, the accompaniment pattern is sequence data, including event data for producing rhythm sounds, bass sounds, and chord sounds. The bass sounds and chord sounds are all prescribed at a standard pitch based on CM7 (C minor 7) chord. Accordingly, in actually producing a sound, the event data is corrected/shifted on the basis of currently specified root and type, and is then sent to the sound source circuit 21. The main section data is style data used for reproducing a regular accompaniment during the automatic playing. The fill-in section data is inserted into main section data at a caesura. The introduction section data is reproduced at the beginning of a music. The ending section data is reproduced at the end of the music. Since the main style data is reproduced cyclicly or repeatedly, the main style data is constructed so as to ensure a smooth connection at the end and top thereof. A section number is assigned to each piece of the section data as follows: 1 for main section, 2 for fill-in section, 3 for introduction section, and 4 for ending section.

FIG. 3 is a diagram showing the correspondence between style data and style number, i.e., identification code in the style data memory. FIG. 3 shows bank 1 only. Generally, the style data are registered in electronic musical instruments provided with an automatic playing apparatus or an automatic playing function. However, a complete set of the style data shown in FIG. 3 are not stored, and only part of them are registered in many cases for economical reasons or else. Even in such a case, the correspondence between the content of style data and the style number is held unique as indicated by FIG. 3. Accordingly, if the same bank number and the style number are designated, the same style data will be selected commonly in any electronic musical instrument provided with an automatic playing apparatus or an automatic playing function.

The style data are sorted or organized in terms of genre. Genre names shown in FIG. 3 are Dance, Ballad, Rock & Pop, Rhythm & Blues, Hard Rock, Rock & Roll, Jazz, Latin, Reggae, and World. Among those genres, Rock & Pop, Hard Rock, and Rock & Roll are similar to each other. Rhythm & Blues and Rock & Roll are also similar to each other. Further, Latin and Reggae are similar to each other.

Figures 4, 5:
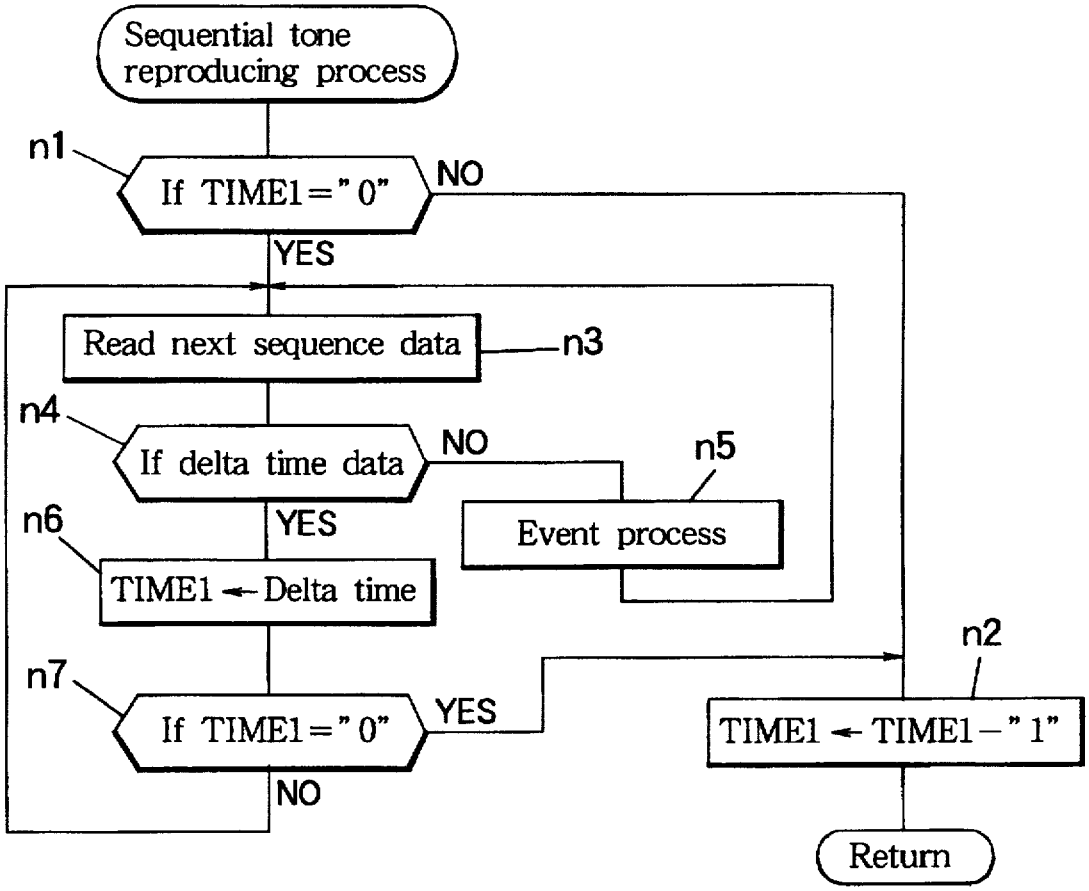
FIG. 4 is a diagram showing configuration of a reference table provided in the electronic musical instrument of FIG. 1.
FIG. 5 is a flow chart showing reproduction operation of the electronic musical instrument of FIG. 1.

FIG. 4 is a diagram showing configuration of a reference table stored in a given memory area of the aforesaid style data memory. The reference table lists, in a corresponding manner, available style data (substitutive styles) for use in an automatic accompaniment in place of designated style data (designated styles) when absent style data not registered in the style data memory is designated. Both of the designated and the substitutive styles are listed in terms of a bank number and a style number. A style identical or similar in genre and identical in meter and preferably identical in beat is selected as a substitutive style. Since available style data registered in the style data memory is listed in the reference table as a substitutive style, the absent style is replaced by the corresponding substitute style without fail. Only one substitutive style will be assigned to one objective style. However, to give variations to the automatic playing, a plurality of substitutive styles are listed as a block for one objective style in the present embodiment. A substitutive style may be selected in actual use from one block at random or in view of compatibility with preceding style data which has just been played.

As described above, in the present embodiment, the reference table (hereinafter, substitution table) is provisionally stored in the style data memory. However, the substitution table, together with song data, may be given from a floppy disk. Otherwise, apart from the song data, the substitution table may be given from another external apparatus through the MIDI interface. When the substitution table is given from outside, the table contains all substitutive styles for all of possibly designated style data. Further, a plurality of substitutive styles are listed therein for each possibly designated style, because it is unknown what kind of style data is stored in the electronic musical instrument. In the electronic musical instrument, when an absent style data not stored in the style data memory is designated, one substitutive style data ranked highest in priority is searched and selected from the substitution table.

The automatic playing operation of the electronic musical instrument will now be described with reference to FIGS. 5 to 10. Since operation in the manual play mode in which a player manually plays on the keyboard 17 is conventionally well known, the description thereof is omitted. FIG. 5 is a flow chart showing a sequential musical tone reproducing operation. This operation is performed in response to an interruption command which is generated by the timer 15 at regular time intervals after the operation of the automatic playing has started. The song data is read from a floppy disk and written into a song data file in the RAM 12 when the automatic playing gets started. First, whether the content of a downcount register TIME1 is 0 or not is determined (n1). The downcount register TIME1 is a register which latches a value of delta time data of the song data and counts down the same each time a timer interruption command is generated. When the content of the TIME1 is not "0", indicating that the timing of reading next sequence data is not reached, a unit value "1" is subtracted from the content of the TIME1 (n2), and thereby returning.

When TIME1="0" is determined at the step indicating that the timing of reading the next sequence data is reached, processing proceeds to step n3 and subsequent steps. At the step n3, the next sequence data is read from the song data file in the RAM 12, and whether the read data is delta time data or event data is determined (n4). When the read data is event data, an event process shown in FIGS. 6A–6D and 7A–7C is executed (n5). On completion of the event process, return to the step n3 is made. When the read data is delta time data, the data is set in the TIME1 (n6), and whether the read data is zero time data or not is determined (n7). When the data is the zero time data, a return to the step n3 is made to continue reading of next event data. When the data is not the zero time data, the value "1" is subtracted from the content of the TIME1 (n2) after making determination at the step n7, and then a return is made.

Figure 6A:
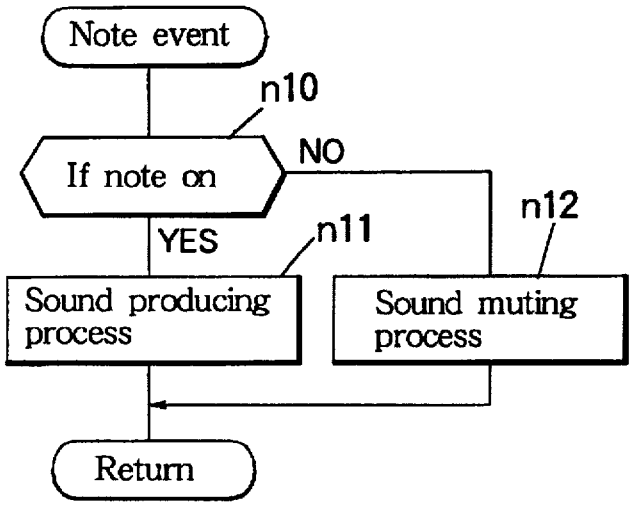
FIGS. 6A, 6B, 6C and 6D are a flow chart showing event operation of the electronic musical instrument of FIG. 1.

FIGS. 6A–6D and 7A–7C are flow charts showing the event process. The event process includes processes corresponding to all event data prescribed in the song data. FIG. 6A shows operation performed when note event data is read. When the note event data is read, whether the data is note ON event data or note OFF event data is determined (n10). When the data is note ON event data, a channel number, a note number, velocity data and the like contained in the note ON event data are sent to the sound source circuit 21 to execute the sound producing process (n11). On the other hand, when the data is note OFF event data, muting data is sent to the sound source circuit 21 at a corresponding sound producing channel to execute a sound muting process (n12).

Figure 6B:
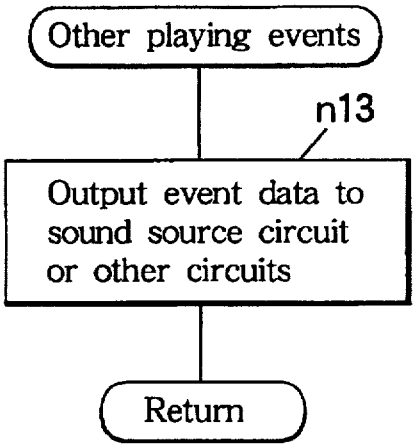

FIG. 6B is a flow chart showing other playing events process. Other playing events are a pitch bend event, a sound volume adjusting event, and a tempo change event, for example. When such a playing event data is read, the data is outputted to a corresponding operation unit such as the sound source circuit 21, the timer 15 and the like (n13).

Figure 6C:
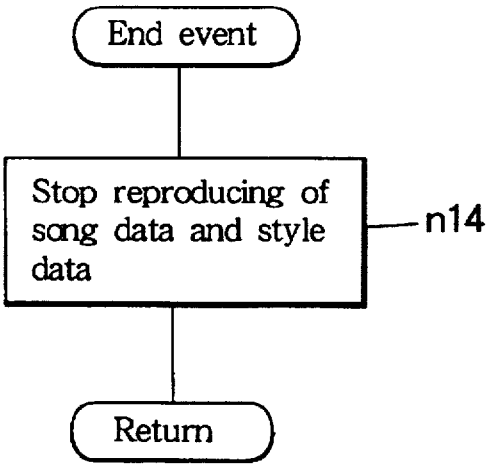

FIG. 6C is a flow chart showing a process executed when end data is read. When the end data is read, an instruction to stop producing of the sound is issued to all of the sound source channels which are producing the sound by automatic playing. Further, a timer interruption process shown in FIG. 5 and FIG. 9, described later, is disabled (n14). As a result, musical sounds reproduced based on the song data and the style data are all muted to end the automatic playing.

Figure 6D:
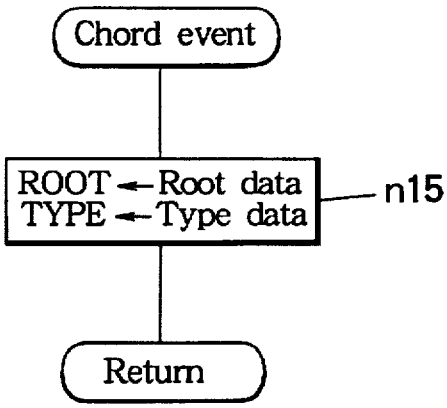

FIG. 6D is a flow chart showing a process executed when chord data is read. The chord data is composed of root data and type data. The root data is set in the ROOT register, and the type data is set in the TYPE register (n15). The ROOT and TYPE registers are reset when the automatic playing starts.

Figure 7A:
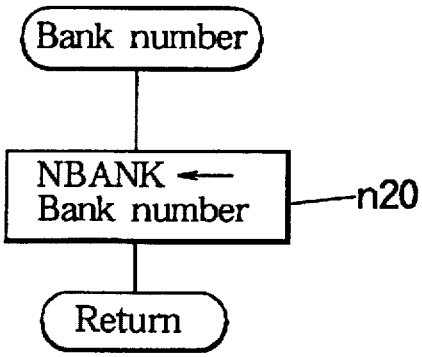
FIGS. 7A, 7B and 7C are a flow chart showing event operation of the electronic musical instrument of FIG. 1.
Figure 7B:
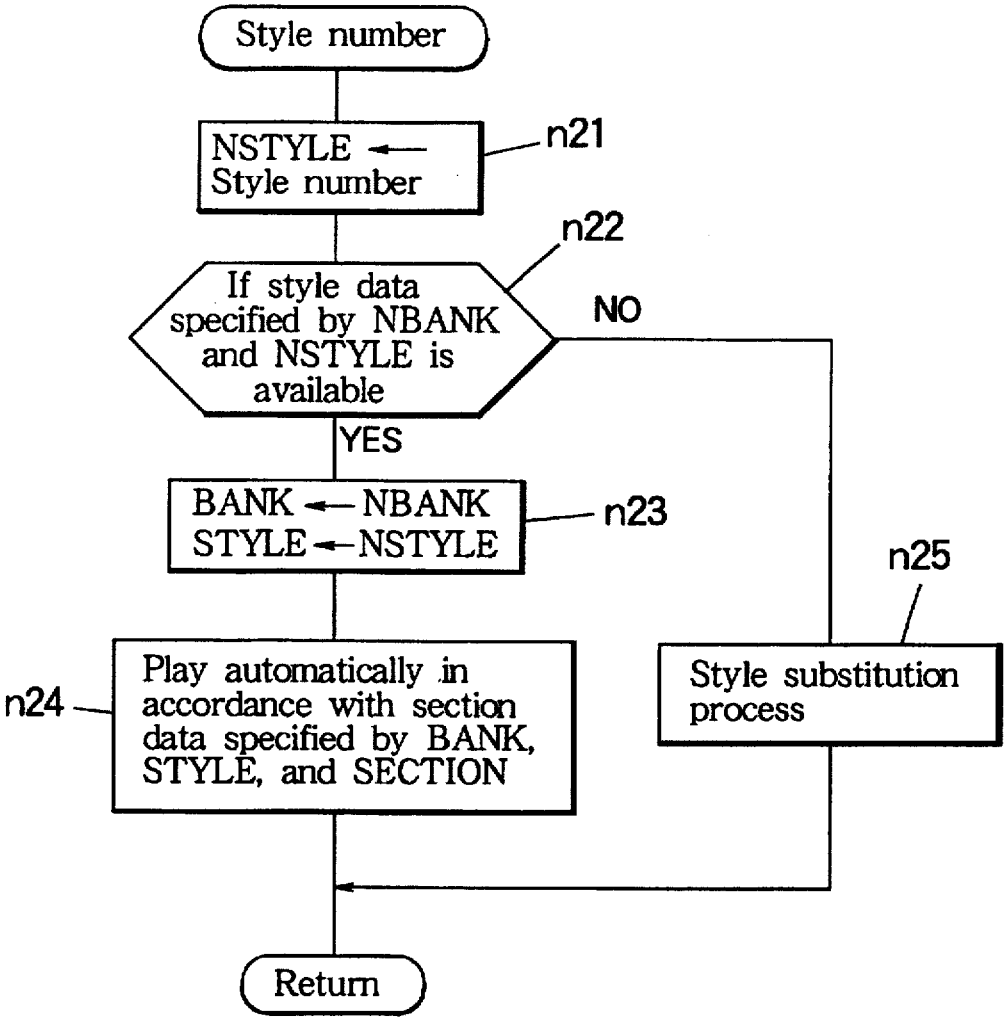
Figure 7C:
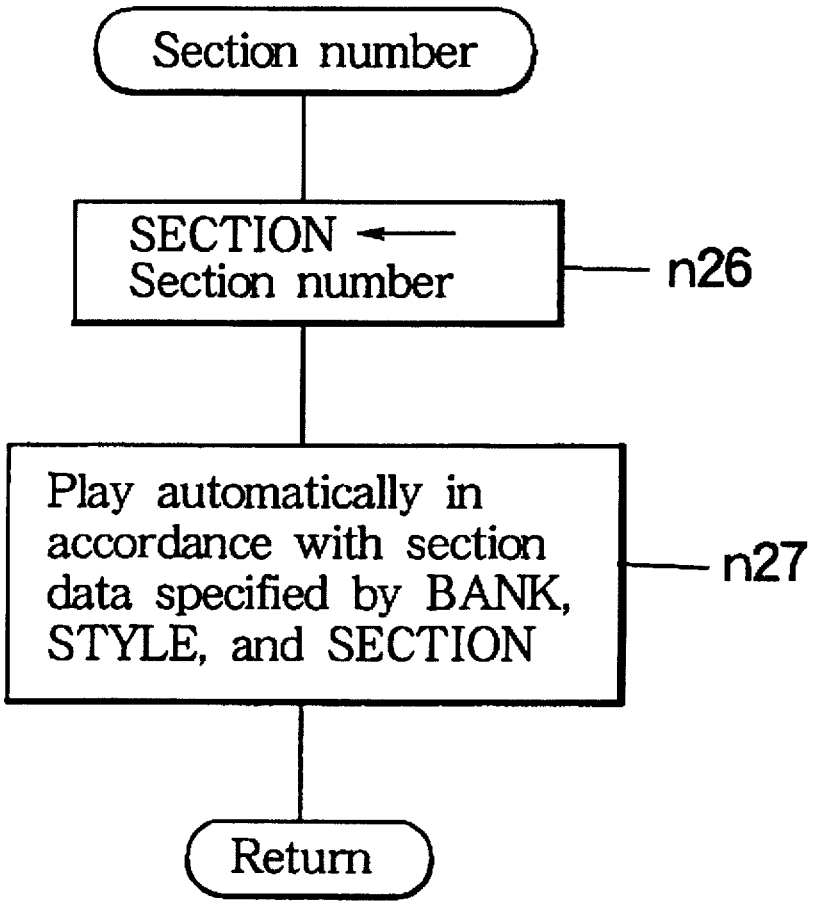

FIGS. 7A–7C show operation performed when style designation event data is read to designate style data. FIG. 7A shows operation performed when a bank number is specified by a bank number specifying event. When a bank number is specified, this bank number is set in a new bank number register NBANK (n20), and then a return is made. When another bank number is subsequently specified next time, the content of the new bank number NBANK is reserved in a bank number register BANK.

FIG. 7B is a flow chart showing operation performed when a style number is specified by a style number specifying event. When a style number is specified, this style number is set in a new style number register NSTYLE (n21). Next, check is made as to whether style data designated by the new style number NSTYLE and the bank number NBANK is registered in the style data memory (n22). When the designated style data is stored, the new style number NSTYLE and the new bank number NBANK are set in the specified style number register STYLE and the specified bank number register BANK, respectively (n23). Then, the automatic playing of an accompaniment starts in accordance with section data specified by a section number SECTION in the style data designated by STYLE and BANK (n24). Namely, a read pointer to the section data is set consistently with the current progress of the automatic playing, and a number of clocks until the timing of reading next sequence data is reached is set in a downcount register TIME2 for the style data. Then, a return is made. On the other hand, when the style data designated by NSTYLE and NBANK is not available in the style data memory, a style substitution process (n25) is executed. The style substitution process will be described later in detail.

FIG. 7C is a flow chart showing operation performed when a section number is specified by a section number specifying event. When a section number is newly specified or updated, this section number is set in a section number register SECTION (n26), and the automatic playing of an accompaniment starts in accordance with the section data specified by the section number SECTION contained in the style data specified by STYLE and BANK (n27). Namely, a read pointer to the section data is set consistently with the current progress of automatic playing, and a number of clocks until the timing of reading next sequence data is reached is set in the downcount register TIME2 for the style data. Then, a return is made.

Figure 8:
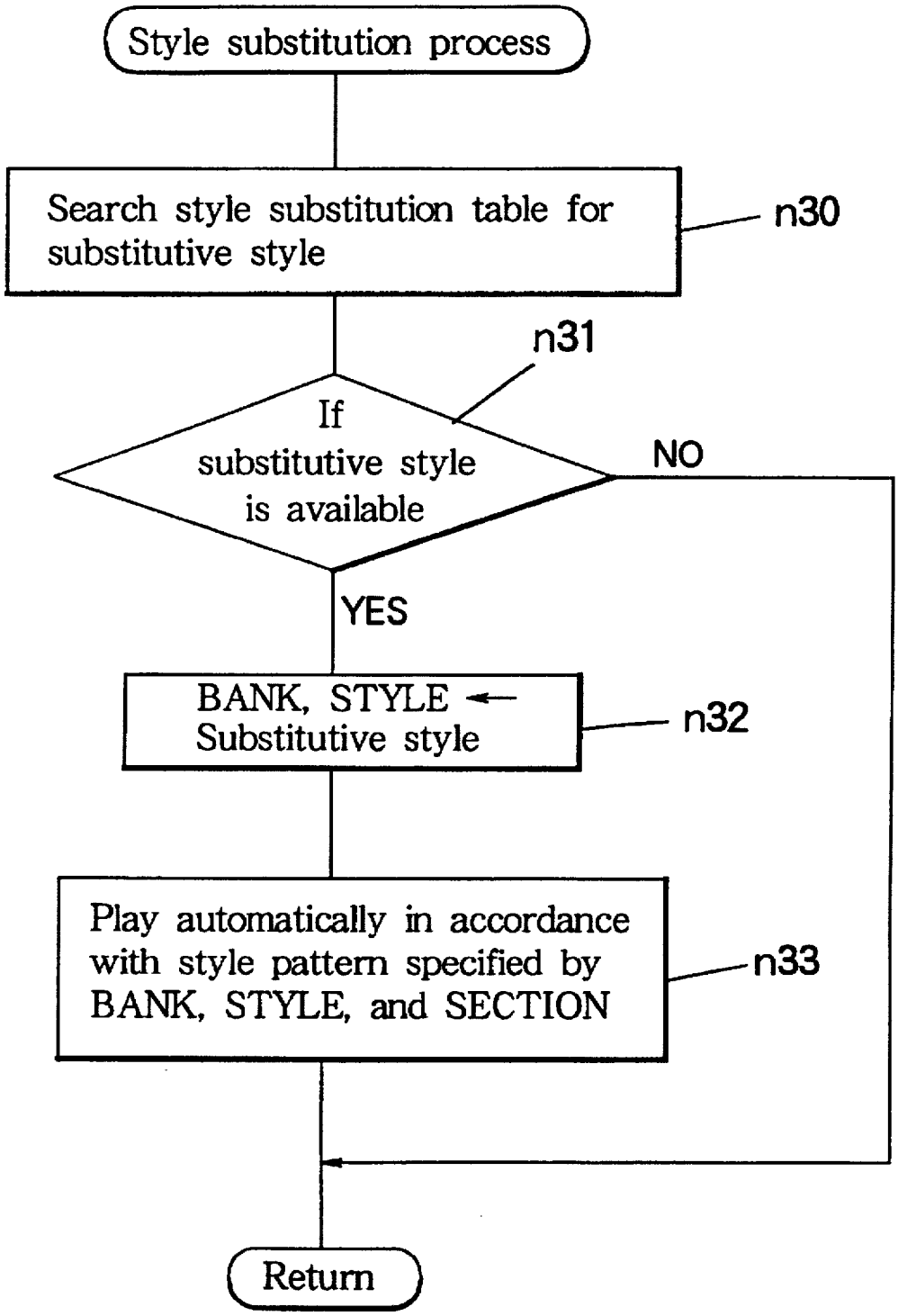
FIG. 8 is a flow chart showing substitution operation of the electronic musical instrument of FIG. 1.

FIG. 8 is allow chart showing a style substitution process. The substitution table (see FIG. 4) is searched according to style data designated by NSTYLE and NBANK so as to find a substitutive style listed in the table (n30). When a substitutive style is found in the substitution table, processing proceeds from a step n31 to a step n32. At the step n31, when a record regarding the designated or specified style is not available or when style data of a substitutive style is not stored in the style data memory, the determination NO is made, and then a return is made. In this case, the processing passes through the style number specifying event of FIG. 7B without rewriting STYLE and BANK, thus continuing the automatic playing in the present style. Stated otherwise, the present style substitutes for the absent style.

At the step n32, a bank number and a style number of the substitutive style extracted by the search are written into BANK and STYLE, and the automatic playing of an accompaniment starts in accordance with section data specified by the section number SECTION prescribed in the style data specified by STYLE and BANK (n33). Namely, a read pointer to the section data is set consistently with the current progress of the automatic playing, and the number of clocks until the timing of reading next sequence data is reached is set in the downcount register TIME2 for the designated style data. Then, a return is made. When a plurality of substitutive styles are found available for choice as a result of searching the substitution table, one substitutive style ranked highest in priority may be selected, or any substitutive style may be selected at random.

Figure 9:
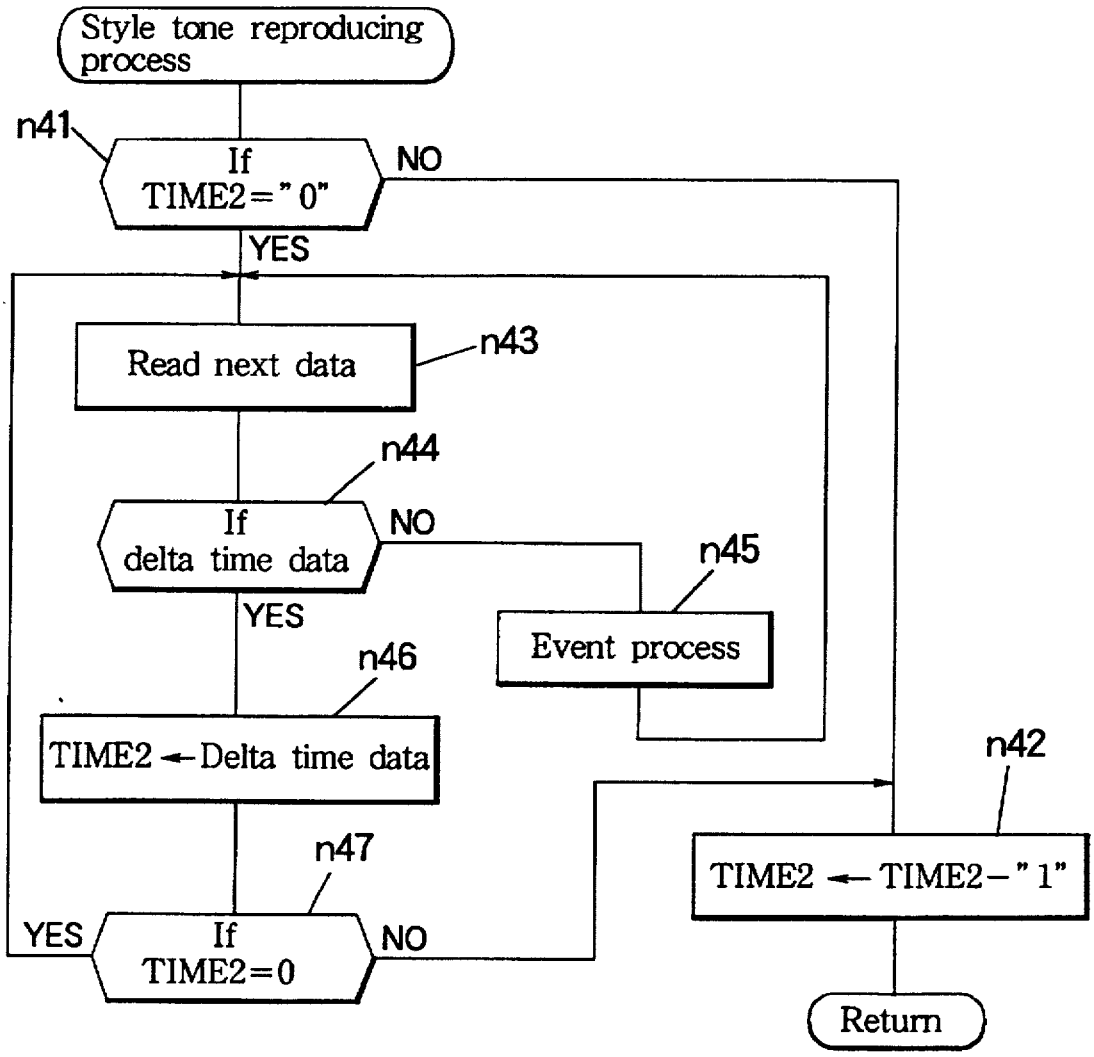
FIG. 9 is a flow chart showing reproduction operation of the electronic musical instrument of FIG. 1.

FIG. 9 is a flow chart showing a style or accompaniment tone reproducing process. This operation is performed in parallel with the sequential or melody tone reproducing operation (FIG. 5) of the song data by the same timer interruption. First, check is made as to whether the content of the downcount register TIME2 is "0" or not (n41). The downcount register TIME2 is a register which reads a value of delta time data from the section data, and which counts down each time a timer interruption command is generated. When the content of the TIME2 is not "0", indicating that the timing of reading next sequence data is not reached, a unit value "1" is subtracted from the content of the TIME2 (n42), and a return is made.

When TIME2=0 is determined at the step n41, indicating that the timing of reading the next sequence data is reached, processing proceeds to a step n43 and subsequent steps. At the step n43, the next sequence data is read from the corresponding section data. Then, check is made as to whether the read data is delta time data or event data (n44). When the read data is event data, an event process shown in FIG. 10 is executed (n45). On completion of the event process, a return to the step n43 is made. When the read data is delta time data, the data is set in the TIME2 (n46), and whether the data is zero time data or not is determined (n47). When the data is zero time data, a return to the step n43 is made to continue reading of event data. When the data is not zero time data, the value "1" is subtracted from the content of the TIME2 (n42) after making determination at the step n47, and thereby returning.

Figure 10A:
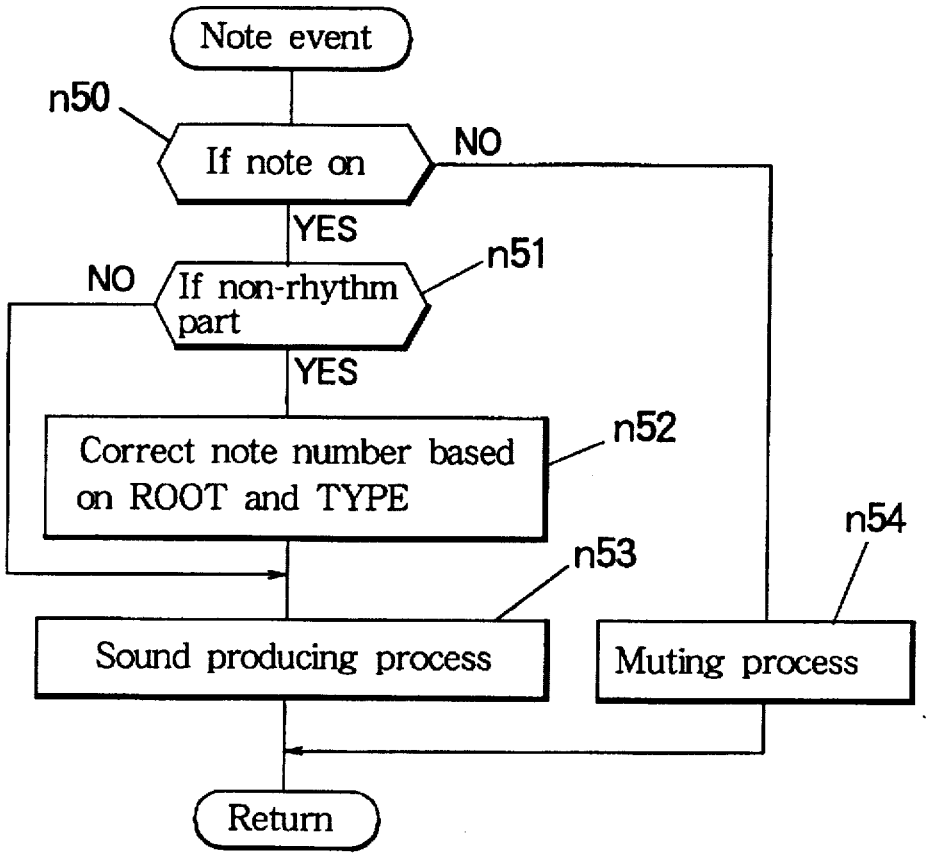
FIGS. 10A, 10B and 10C are a flow chart showing event operation of the electronic musical instrument of FIG. 1.

FIG. 10A shows operation performed when note event data is read. When note event data is read, whether the data is note ON event data or note OFF event data is determined (n50). When the data is note ON event data, whether the note ON event data is rhythm part data or non-rhythm part data is determined (n51). This determination is made based on a channel number contained in the note event data. When the note ON event data is of rhythm part, a channel number, a note number indicative of a kind of a rhythm tone, velocity data and the like contained in the note ON event data are sent to the sound source circuit 21 to execute a rhythm sound producing process (n53). On the other hand, when the note ON event data is of non-rhythm part, a pitch is corrected for the currently specified chord (ROOT and TYPE) (n52), and then a channel number, a note number, velocity data and the like contained in the event data are sent to the sound source circuit 21 to execute an instrument sound producing process (n53). When the read note event data is note OFF event data, muting data is sent to the sound source circuit 21 at a corresponding sound producing channel to execute a muting process (n54).

Figure 10B:
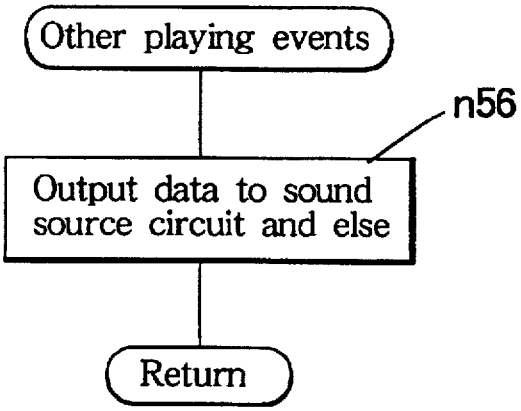

FIG. 10B is a flow chart showing other playing events process. Other playing events are a pitch bend event, a sound volume adjusting event, and a tempo change event, for example. When such playing event data is read, the data is outputted to a corresponding operation unit such as the sound source circuit 21, the timer 15 and the like (n56).

Figure 10C:
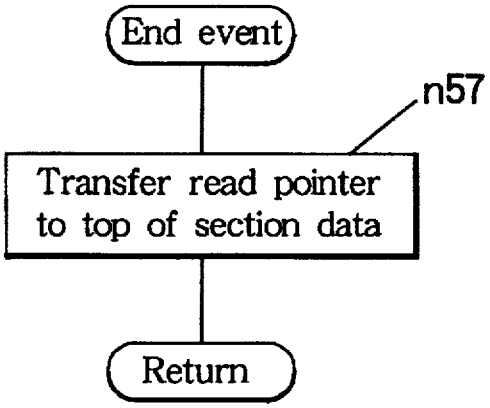

FIG. 10C is a flow chart showing a process executed when end event data is read. The end event data contained in the section data does not indicate the end of automatic playing, but denotes the end of the accompaniment pattern. Thus, when the end event data is read, the read pointer is transferred to the top of the section data, whereby the accompaniment pattern can be repeatedly continued (n57).

According to the above mentioned operation, when one of style data sequentially specified by the song data is not available in the electronic musical instrument, substitutive style data is selected on the basis of the substitution table, and the accompaniment is automatically continued on the basis of the substitutive style data. According to the present embodiment, the substitution table (FIG. 4) is prepared a style by style, and the style substitution process (FIG. 8) is executed when a substitute style number is specified. However, the substitution table may be prepared a section by section, and section data most similar to the designated section data may be used as a substitute whenever absent section data is designated. Also, the substitution table may be adapted to allow the user to rewrite or add data thereto.

Besides the above mentioned method which is illustrated with the substitution table in FIG. 4 and the style substitution process in FIG. 8, various methods for selecting a substitutive style may be employed. An operation of selecting a substitutive style according to second and third embodiments of the invention will now be described with reference to FIGS. 11, 12A and 12B.

Figure 11:
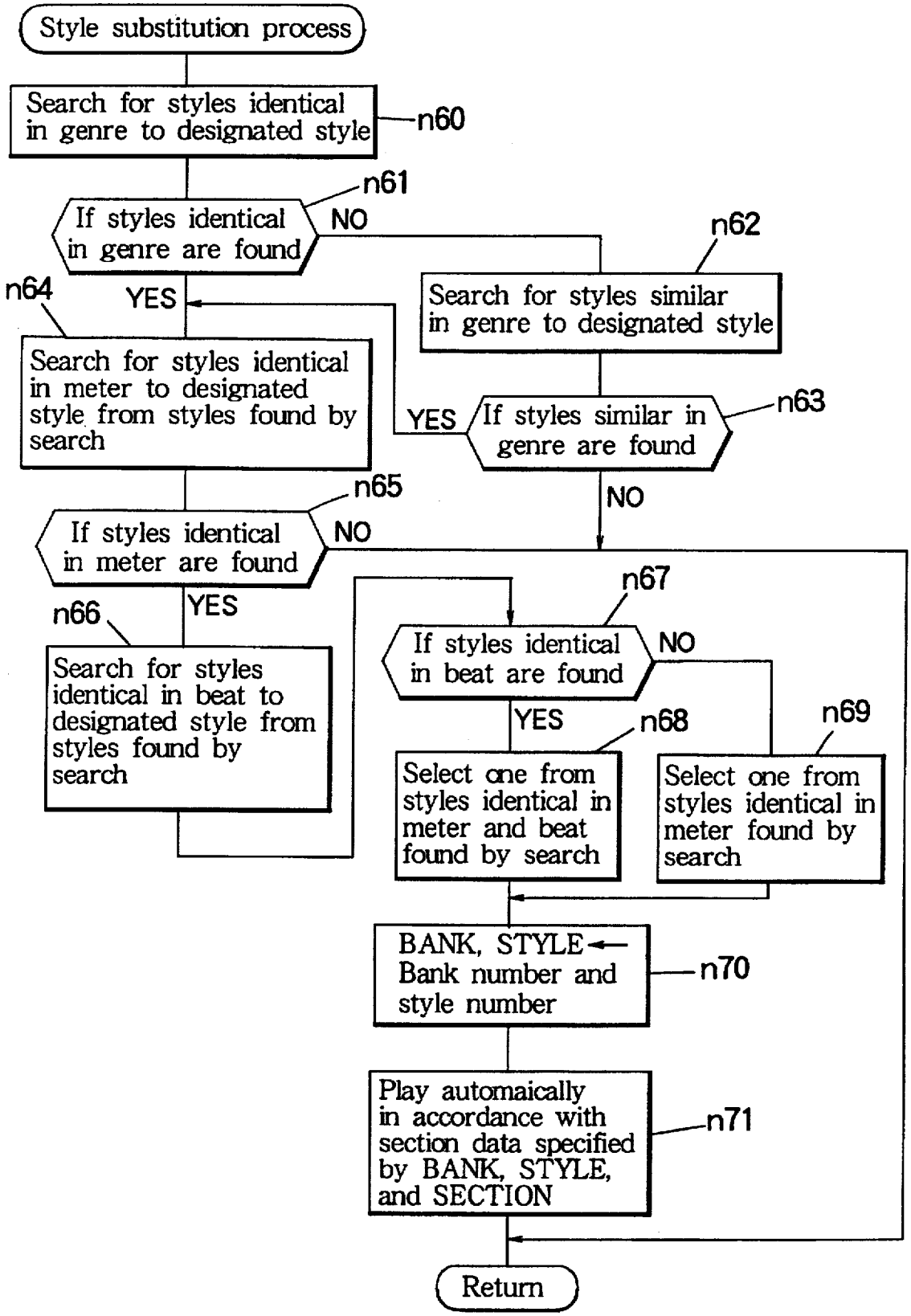
FIG. 11 is a flow chart showing substitution process according to a second embodiment of the invention.

FIG. 11 is a flow chart showing a style substitution process according to the second embodiment. In the present embodiment, the substitution table is not used, and style data similar to that specified by NBANK and NSTYLE is selected directly from the content of the style data memory for use as a substitutive style. Similarity of style data is determined on the basis of reference information such as genre, meter, and beat. For each of style data stored in the style data memory, genre, meter, and beat are written in the header of the style data as the reference information. Further, genre, meter, and beat of style data specified in the song data are assumed to be recognized by a certain method. Examples of such a recognition method include a method in which the reference information is written in a style designation event of the song data, and another method in which genre, time, and beat of all possible style data are stored in the style data memory regardless of whether the style data itself is registered or not.

First, the style data memory is searched for style data identical in genre to a designated style (n60). When style data identical in genre are found by the search (n61), the found style data are further examined to find style data identical in meter to the designated style (n64). When style data identical in meter are found by the examination, the found style data are further checked to find style data identical in beat to the designated style (n66). When style data identical in beat is found, this style data is finally selected as substitutive style data (n67 and n68). When a plurality of style data are finally found, one of them is selected (n68). On the other hand, when there is no style data identical in beat, one of style data is selected, either at random or in accordance with a predetermined rule, for use as substitutive style data from style data identical in meter which are found at the step n64 by search (n69). A bank number and a style number of the thus selected substitutive style data are set in BANK and STYLE (n70). Subsequently, the automatic playing of an accompaniment starts in accordance with section data specified by the section number SECTION prescribed in the style data designated or specified by STYLE and BANK (n71), and then a return is made. Namely, a read pointer to the section data is set consistently with the current progress of the automatic playing, and the number of clocks until the timing of reading next sequence data is reached is set in the downcount register TIME2 for the style data. As described above, the present embodiment does not employ the substitution table, but is adapted to retrieve a substitutive style on the basis of reference information indicative of a category of each style data.

On the other hand, when no style data identical in genre to the designated style is found at the step n61, a search for style data similar in genre is executed (n62). When style data similar in genre are found, processing is restored via step n63 to the step n64. When, unfortunately style data similar in genre is not found, a return is made without performing any effective operation on the assumption that substitutive style data is not available. Also, even when style data identical or similar in genre are found by the search, if style data identical in meter is not found by the subsequent search, a return from the step n65 is made on the assumption that substitutive style data is not available. Thus, the automatic playing continues in the current style.

Figure 12A:
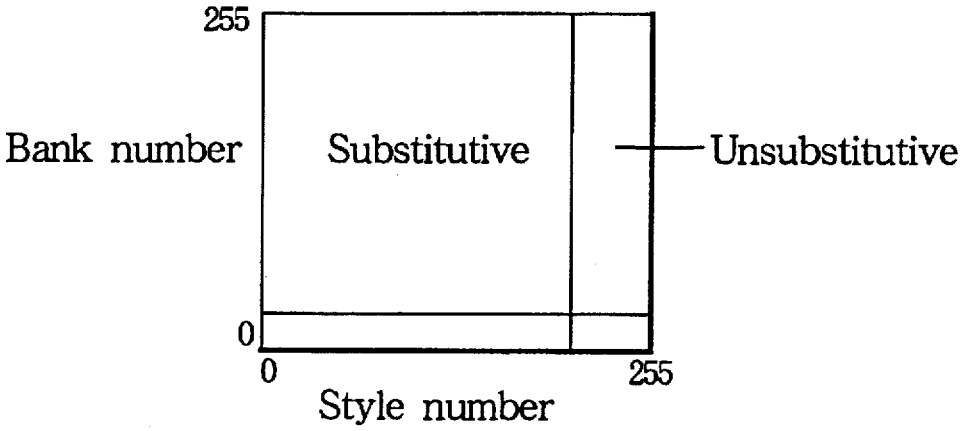
FIGS. 12A and 12B are a diagram showing substitution process according to a third embodiment of the invention.
Figure 12B:
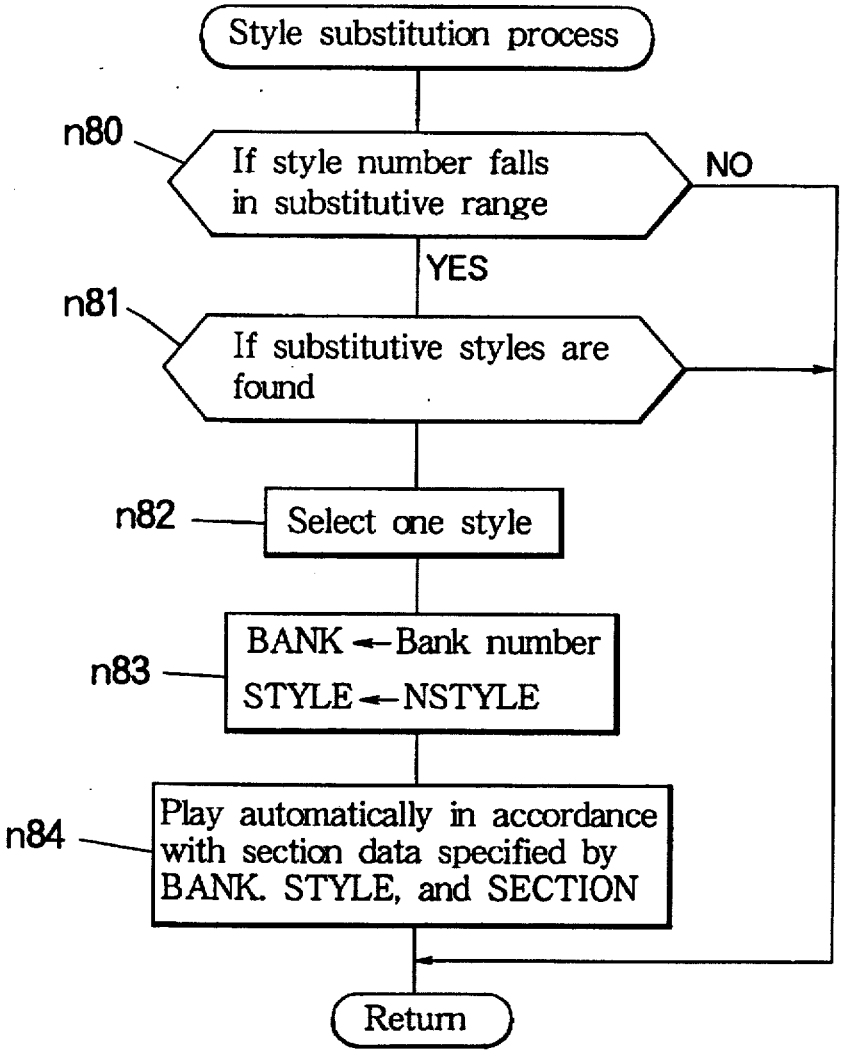

FIGS. 12A and 12B are a diagram showing a style substitution process according to the third embodiment. FIG. 12A is a diagram showing a style data memory used in the present embodiment. In the present embodiment, style data are classified or sorted according to genre, meter, and beat. Further, style data identical in genre, meter, and beat are all stored in one group labeled by a primary code in the form of an identical style number. Most basic style data identical in genre, meter, and beat is stored in bank 0. Variations of the basic style are stored in banks 1 to 255 under the identical style number. Stated otherwise, various styles contained in one group are labeled individually by secondary codes in the form of the bank numbers. Accordingly, when a designated style is not available, style data identical in a style number and different in a bank number is selected for use as a substitutive style, whereby similar and appropriate style data can be selected. A storage area ranging from 238 to 255 in style number is reserved for unsubstitutive style data. That is, style data stored in this range cannot be used as a substitute even when a style number of the absent pattern is identical. Style data which cannot substitute for absent style data include user-created style data and special ethnic style data, for example.

FIG. 12B is a flow chart showing a style substitution process according to the third embodiment. First, when a style designated by NBANK and NSTYLE is not available, check is made as to whether the style number NSTYLE falls in the substitutive range (n80). If it is a number falling in the substitutive range, search for style data having different bank numbers and the identical style number is executed (n81). When relevant style data are found by the search, an optimum one of the style data is selected (n82). Then, the bank number of the selected style data is set in BANK, and also NSTYLE is set to STYLE (n83). Subsequently, the automatic playing of an accompaniment starts in accordance with section data specified by the section number SECTION prescribed in the style data designated by STYLE and BANK (n84), and then a return is made. Namely, a read pointer to the section data is set consistently with the current progress of the automatic playing, and the number of clocks until the timing of reading next sequence data is reached is set in the downcount register TIME2 for the style data.

As a result, similar style data can be selected only by specifying bank numbers. At the step n83, the bank number BANK may be unconditionally set to 0. According to the substitution process in this case, when style variations are not available, a basic style is used as a substitute. In the present embodiment, style data are organized and grouped according to genre, meter, and beat, and only style data identical in genre, meter, and beat are stored under the identical style number. However, style data may be classified by genre and meter, and style data identical in genre and meter may be grouped under the identical style number, and also a bank number may be used for identifying a beat of the grouped style data. Also, in the present embodiment, when the style data memory is to be expanded, the relationship between style numbers and the content of style data remains intact. Namely, the content of the memory is configured such that style data identical or similar in genre are stored under the identical style number.

In the aforesaid embodiments, by standardizing the content of style data and corresponding style numbers and bank numbers among a plurality of equipment models, even when the identical song data is reproduced by equipments of different models, the melody can be represented in similar atmosphere. In the aforesaid embodiments, designation event data to specify style data is written in the song data. Besides this method, style data may be designated by an external apparatus. In the aforesaid embodiments, style data is not used as a substitute unless genre is identical or similar. However, in the worst case, even when genre is not identical or similar, style data may be used as a substitute if meter is identical. Furthermore, in the aforesaid embodiments, style designation data to specify style data such as style number and the like is read when reproducing the song data. Then, check is made as to whether the style data is stored or not. If the style data is not stored, substitutive style data is determined. However, before the song data is reproduced, style data in the song may all be extracted. After determining whether style data is stored or not with all the style data and then selecting substitutive styles, the song data may start to be reproduced.

As has been stated above, according to the invention, when a performance pattern not stored in the pattern storage is designated, an appropriate pattern is selected as a substitute to place automatic playing into operation, whereby the automatic playing is not interrupted even when the designated pattern is absent. In this case, the inventive apparatus uses a substitution method in which patterns for use as a substitute are listed in a substitution table, or another substitution method in which a similar pattern akin to a designated pattern is extracted as a substitutive pattern from the pattern storage, or a further substitution method in which similar patterns are sorted in groups. By selecting a substitutive pattern from one group, the substitutive pattern can be selected more precisely, whereby the automatic playing becomes possible in closer atmosphere to an original melody.

What is claimed is:

1. An automatic playing apparatus comprising:

storage means for registering pattern data representative of a plurality of performance patterns, each of the performance patterns being composed of a sequence of note events arranged to define a section of a music composition;

designating means for sequentially designating performance patterns to form a music composition;

playing means for sequentially retrieving the pattern data of the designated performance patterns from the storage means to reproduce a sequence of the designated performance patterns to undergo an automatic play of the music composition; and substituting means operative when the designating means designates an absent performance pattern which is not registered in the storage means for substituting an available one of the registered performance patterns in the storage means for the absent performance pattern so as to maintain the automatic play.

2. An automatic playing apparatus according to claim 1, wherein the substituting means comprises:

means defining a reference table which lists performance patterns in an organized manner; and searching means operative when an absent performance pattern is designated for searching the reference table so as to select one of the listed performance patterns for substitution of the absent performance pattern.

3. An automatic playing apparatus according to claim 2, wherein the reference table is organized into a plurality of blocks such that the searching means specifies one block corresponding to the absent performance pattern and selects one listed performance pattern from the specified block.

4. An automatic playing apparatus according to claim 1, wherein the substituting means comprises searching means operative when an absent performance pattern is designated for searching the storage means to select therefrom one registered performance pattern which is akin to the absent performance pattern to thereby substitute therefor.

5. An automatic playing apparatus according to claim 4, wherein the searching means comprises selecting means for selecting an akin performance pattern which has an identical or similar genre as that of the absent performance pattern.

6. An automatic playing apparatus according to claim 5, wherein the selecting means comprises means for selecting the akin performance pattern having the same meter as that of the absent performance pattern.

7. An automatic playing apparatus according to claim 6, wherein the selecting means comprises means for selecting the akin performance pattern having the same beat as that of the absent performance pattern.

8. An automatic playing apparatus according to claim 4, wherein the storage means registers the pattern data containing reference information which prescribes attributes of the registered performance patterns such that the searching means selects one registered performance pattern akin to the absent performance pattern according to the reference information.

9. An automatic playing apparatus according to claim 1, wherein the storage means comprises means for storing the pattern data in an organized manner such that the plurality of the performance patterns are sorted into groups labeled by primary codes, each group containing similar performance patterns labeled individually by secondary codes, and wherein the substituting means comprises selecting means operative when the designating means designates an absent performance pattern having certain primary and secondary codes for specifying one group having the same primary code as that of the absent performance pattern and for selecting from the specified group one registered performance pattern having a secondary code different than that of the absent performance pattern so as to substitute therefor.

10. An automatic playing apparatus according to claim 9, wherein the selecting means comprises means for selecting said one registered performance pattern having the same meter as that of the absent performance pattern.

11. An automatic playing apparatus according to claim 10, wherein the selecting means comprises means for selecting said one registered performance pattern having the same beat as that of the absent performance pattern.

12. An automatic playing apparatus according to claim 1, including memory means for storing automatic music data which prescribes a music composition for an automatic performance and which contains designation information so that the designating means retrieves the designation information from the memory means for designating a sequence of performance patterns according to the retrieved designation information.

13. An automatic playing apparatus according to claim 1, wherein the designating means comprises means receptive of external automatic music data which prescribes a music composition for an automatic performance including designation information, for designating a sequence of performance patterns according to the received designation information.

14. An automatic playing apparatus according to claim 1, wherein the storage means comprises means for registering the performance patterns labeled by identification codes such that the designating means sequentially designates the performance patterns in terms of the identification codes.

15. An automatic playing apparatus according to claim 1, wherein the substituting means includes means operative when the designating means designates a present performance pattern which is registered in the storage means and subsequently designates an absent performance pattern which is not registered in the storage means, for substituting the present performance pattern for the absent performance pattern.

* * * * *